US008870408B2

(12) United States Patent
Sharrah

(10) Patent No.: US 8,870,408 B2
(45) Date of Patent: Oct. 28, 2014

(54) PORTABLE LIGHT AND WORK LIGHT ADAPTER THEREFOR

(71) Applicant: Streamlight, Inc., Eagleville, PA (US)

(72) Inventor: Raymond L. Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 13/834,591

(22) Filed: Mar. 15, 2013

(65) Prior Publication Data

US 2013/0258650 A1 Oct. 3, 2013

Related U.S. Application Data

(60) Provisional application No. 61/619,066, filed on Apr. 2, 2012.

(51) Int. Cl.

| | |
|---|---|
| ***F21V 29/02*** | (2006.01) |
| ***F21L 4/00*** | (2006.01) |
| ***F21V 23/02*** | (2006.01) |
| *F21Y 103/00* | (2006.01) |
| *F21W 111/10* | (2006.01) |
| *F21V 23/00* | (2006.01) |
| *F21V 21/08* | (2006.01) |
| *F21Y 101/02* | (2006.01) |
| *F21V 29/00* | (2006.01) |

(52) U.S. Cl.

CPC ..... *F21V 23/026* (2013.01); *F21Y 2103/003* (2013.01); *F21W 2111/10* (2013.01); *F21V 23/005* (2013.01); *F21L 4/00* (2013.01); *F21V 21/08* (2013.01); *F21Y 2101/02* (2013.01); *F21V 29/20* (2013.01)

USPC ..... 362/217.13; 362/217.12; 362/157; 362/202; 362/249.02; 362/205

(58) Field of Classification Search

CPC ..... F21Y 2101/00; F21Y 2103/003; F21V 23/02; F21V 23/06; F21V 23/005; F21V 23/026; F21L 4/00

USPC ..... 362/217.13, 190, 191, 200, 202, 382

See application file for complete search history.

(56) References Cited

U.S. PATENT DOCUMENTS

| | | | |
|---|---|---|---|
| 4,415,954 | A | 11/1983 | Schaefer |
| 4,658,336 | A | 4/1987 | Maglica |

(Continued)

OTHER PUBLICATIONS

TerraLUX, "LED Work Lights", http://www.terraluxportable.com/products/ . . . , printed Apr. 2, 2012, 10 pages.

*Primary Examiner* — Sikha Roy

(74) *Attorney, Agent, or Firm* — Clement A. Berard, Esq.; Dann, Dorfman, Herrell & Skillman, PC

(57) ABSTRACT

In a portable light and/or a light source adapter therefor, the open end of a light body has one or more features, and a light source includes an adapter base for being disposed in the open end of the light body. The adapter base has one or more features in an asymmetric pattern complementary to that of the features of the light body, so the adapter base seats in the light body only with the complementary features in a predetermined rotational relationship for mating. The light source may be connected to an electrical connection of the adapter base that mates with the electrical connection of the light body when the adapter base is seated in the predetermined rotational relationship for mating. The light source may preferably be retained in the light body by a retainer.

28 Claims, 7 Drawing Sheets

(56) References Cited

U.S. PATENT DOCUMENTS

| | | | | |
|---|---|---|---|---|
| D307,488 | S | 4/1990 | Sharrah | |
| D322,139 | S | 12/1991 | Wang | |
| D351,675 | S | 10/1994 | Sharrah et al. | |
| D353,216 | S | 12/1994 | Sharrah et al. | |
| 5,432,689 | A | 7/1995 | Sharrah et al. | |
| 5,653,529 | A | 8/1997 | Spocharski | |
| D412,590 | S | 8/1999 | Parsons | |
| D421,813 | S | 3/2000 | Parsons | |
| 6,318,886 | B1 | 11/2001 | Stopa et al. | |
| D473,332 | S | 4/2003 | Lam | |
| 6,853,151 | B2 | 2/2005 | Leong et al. | |
| 6,857,756 | B2 | 2/2005 | Reiff et al. | |
| D505,217 | S | 5/2005 | Bayat et al. | |
| D512,525 | S | 12/2005 | Yang | |
| D521,168 | S | 5/2006 | Waters | |
| 7,152,994 | B2 * | 12/2006 | Huang | 362/205 |
| D536,812 | S | 2/2007 | Bayat et al. | |
| 7,220,013 | B2 | 5/2007 | Sharrah | |
| 7,222,995 | B1 | 5/2007 | Bayat et al. | |
| D551,366 | S | 9/2007 | Galli | |
| 7,281,820 | B2 | 10/2007 | Bayat et al. | |
| 7,296,913 | B2 | 11/2007 | Catalano et al. | |
| 7,300,173 | B2 | 11/2007 | Catalano et al. | |
| 7,318,661 | B2 | 1/2008 | Catalano | |
| 7,334,918 | B2 | 2/2008 | Newton et al. | |
| 7,338,189 | B2 | 3/2008 | Kovacik et al. | |
| 7,402,961 | B2 | 7/2008 | Bayat et al. | |
| D574,741 | S | 8/2008 | Gadsden | |
| 7,448,770 | B2 | 11/2008 | Catalano et al. | |
| 7,492,063 | B2 | 2/2009 | Bayat et al. | |
| 7,597,456 | B2 | 10/2009 | Catalano et al. | |
| D603,988 | S | 11/2009 | Sharrah | |
| 7,625,099 | B2 | 12/2009 | Newton et al. | |
| 7,651,240 | B2 | 1/2010 | Bayat et al. | |
| 7,699,494 | B2 | 4/2010 | Catalano et al. | |
| 7,745,957 | B2 | 6/2010 | Bayat et al. | |
| 7,777,430 | B2 | 8/2010 | Catalano et al. | |
| D629,544 | S | 12/2010 | Deguglimo | |
| 7,883,243 | B2 * | 2/2011 | Snyder | 362/294 |
| 7,891,833 | B2 | 2/2011 | Sharrah | |
| D637,749 | S | 5/2011 | Bayat et al. | |
| D638,560 | S | 5/2011 | Steenstra | |
| 7,946,730 | B2 | 5/2011 | Catalano et al. | |
| 8,033,682 | B2 | 10/2011 | Catalano et al. | |
| D668,804 | S | 10/2012 | Maglica | |
| D672,894 | S | 12/2012 | Bayat et al. | |
| D683,877 | S | 6/2013 | Brands | |
| 2003/0189828 | A1 * | 10/2003 | Coushaine | 362/226 |
| 2005/0007778 | A1 * | 1/2005 | Lin | 362/250 |
| 2007/0253194 | A1 | 11/2007 | Sharrah et al. | |
| 2009/0290335 | A1 | 11/2009 | Levine | |
| 2012/0156915 | A1 * | 6/2012 | Wu | 439/345 |
| 2012/0326623 | A1 * | 12/2012 | Fatt et al. | 315/291 |
| 2013/0182419 | A1 * | 7/2013 | Worman | 362/183 |

* cited by examiner

PORTABLE LIGHT AND WORK LIGHT ADAPTER THEREFOR

This application hereby claims the benefit of U.S. Provisional Patent Application No. 61/619,066 entitled "PORTABLE LIGHT AND WORK LIGHT ADAPTER THEREFOR" filed on Apr. 2, 2012 which is hereby incorporated herein by reference in its entirety.

The present invention relates to a portable light and, in particular, to a portable light and a light adapter therefor.

Conventional portable lights, e.g., flashlights, are available with a wide variety of sizes and types of light sources and batteries. Incandescent lamps are designed to be directly connected to a battery and will glow over a relatively wide range of battery voltages to provide useful, if not constant brightness, illumination. In addition, incandescent lamps operate equally well from AC and DC power sources, including DC power sources of either polarity.

While a large number of conventional incandescent light sources were and are compatible with and interchangeable with several or many different lights, e.g., as are the typical conventional metal base incandescent lamps and bi-pin base incandescent lamps, that is no longer the case with the advent of solid state light sources, e.g., light emitting diodes (LEDs).

The configurations of the solid state light sources have tended to become unique, at least in part owing to the unique physical and electrical requirements of the many different types and kinds of available LEDs. Among these are the need to be operated at a particular voltage and/or current that is or are not the voltage and current provided by a common battery or other power source. In addition, solid state light sources, e.g., LEDs, are polarity sensitive and require a particular polarity of operating voltage and current.

Thus, while solid state replacements have become available for some simple and widely used styles of incandescent lamps, e.g., the metal base lamps, there are no suitable solid state replacements for many incandescent lamps. In limited instances where LED substitutes have become available, e.g., for bi-pin base lamps, conventional replacements have substantially exposed pins that are subject to being bent or otherwise damaged. In addition, there is the risk that these replacement light sources may be installed improperly, e.g., not in the correct orientation, whereby the pins thereof may be bent or otherwise damaged, and in many instances, and/or they may be installed with the wrong electrical polarity and so will not operate and can be permanently damaged. The possibility of such damage is increased where it is difficult to view the mating of the pins into their receptacles, as is often the case.

Applicant believes there is a need for a light and light adapter wherein a solid state light source may replace the original incandescent light source, or wherein the adapter can be employed to provide a plurality of different types or kinds of light sources that may be used interchangeably. In addition it would be desirable that such adapter not be as easily damaged and not be subject to insertion with the wrong polarity.

Accordingly, a portable light and light source adapter may comprise: a light body having an open end for receiving a light source therein, the open end exposing a face including one or more features in an asymmetric pattern and one or more electrical connections, the light body may have a cavity for receiving a source of electrical power therein and may include an electrical switch for selectively energizing at least one of the electrical connections. A light source may include an adapter base disposed in the open end of the light body, the adapter base having one or more features extending into the open end of the light body and in an asymmetric pattern that is complementary to the asymmetric pattern of the one or more features of the light body so that the adapter base cannot seat adjacent the face unless their complementary features are in a predetermined rotational relationship for mating.

The adapter base may include one or more electrical connections that mate with the one or more electrical connections on the exposed face only when the adapter base is seated adjacent the face in the predetermined rotational relationship for mating. The light source may include a source of illumination electrically connected to the one or more electrical connections of the adapter base. A retainer may retain the light source disposed in the open end of the light body with the adapter base seated adjacent the face in the predetermined rotational relationship for mating.

A light source adapter for a portable light comprising a light body having an open end for receiving a light source therein, the open end exposing a face including one or more features in an asymmetric pattern and one or more electrical connections, the light body may have a cavity for receiving a source of electrical power therein and may include an electrical switch for selectively energizing at least one of the electrical connections. The light source adapter may comprise: a light source including an adapter base disposable in the open end of the light body, the adapter base having one or more features in an asymmetric pattern that is complementary to the asymmetric pattern of the one or more features of the light body so that the adapter base cannot seat adjacent the face unless their complementary raised bosses are in a predetermined rotational relationship for mating. The adapter base may include one or more electrical connections to mate with the one or more electrical connections on the exposed face only when the adapter base is seated adjacent the face in the predetermined rotational relationship for mating. The light source may include a source of illumination electrically connected to the one or more electrical connections of the adapter base An optional retainer may retain the light source disposed in the open end of the light body with the adapter base seated in the predetermined rotational relationship for mating.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1:
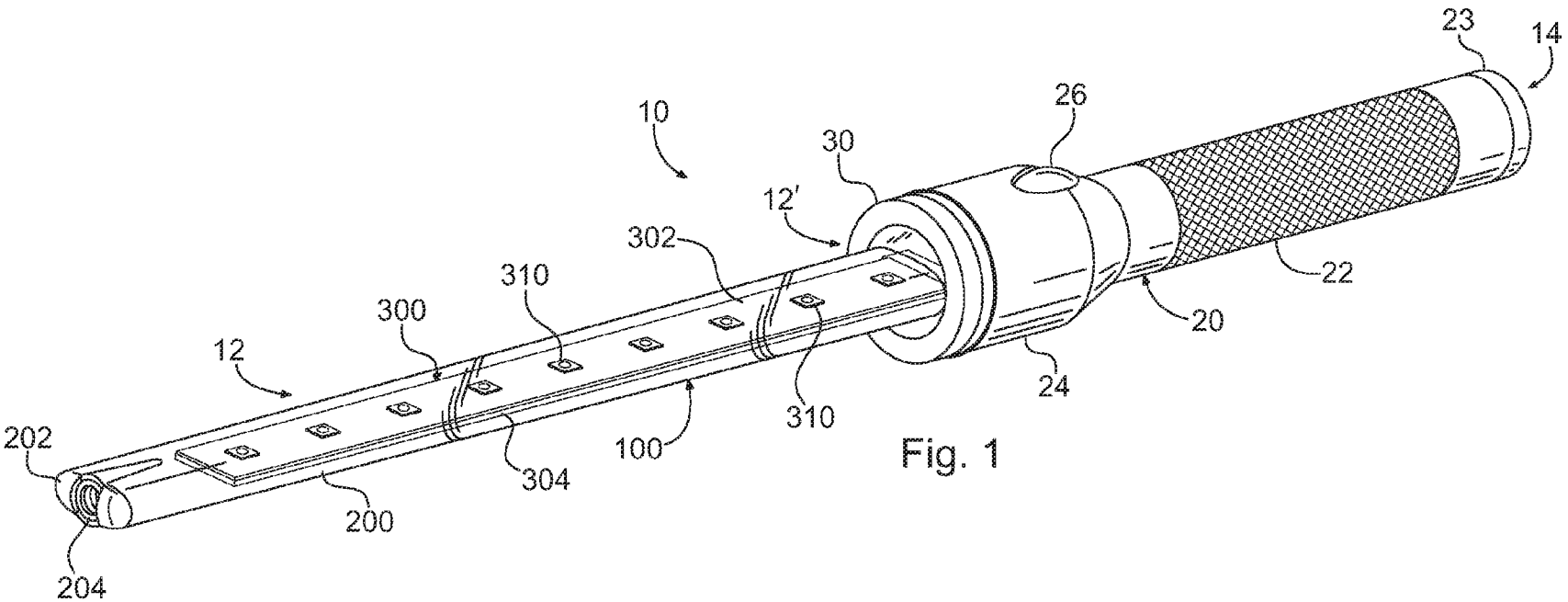
FIG. 1 is a perspective view of an example embodiment of a portable light.

In the Drawing, where an element or feature is shown in more than one drawing figure, the same alphanumeric designation may be used to designate such element or feature in each figure, and where a closely related or modified element is shown in a figure, the same alphanumerical designation primed or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

Figure 2:
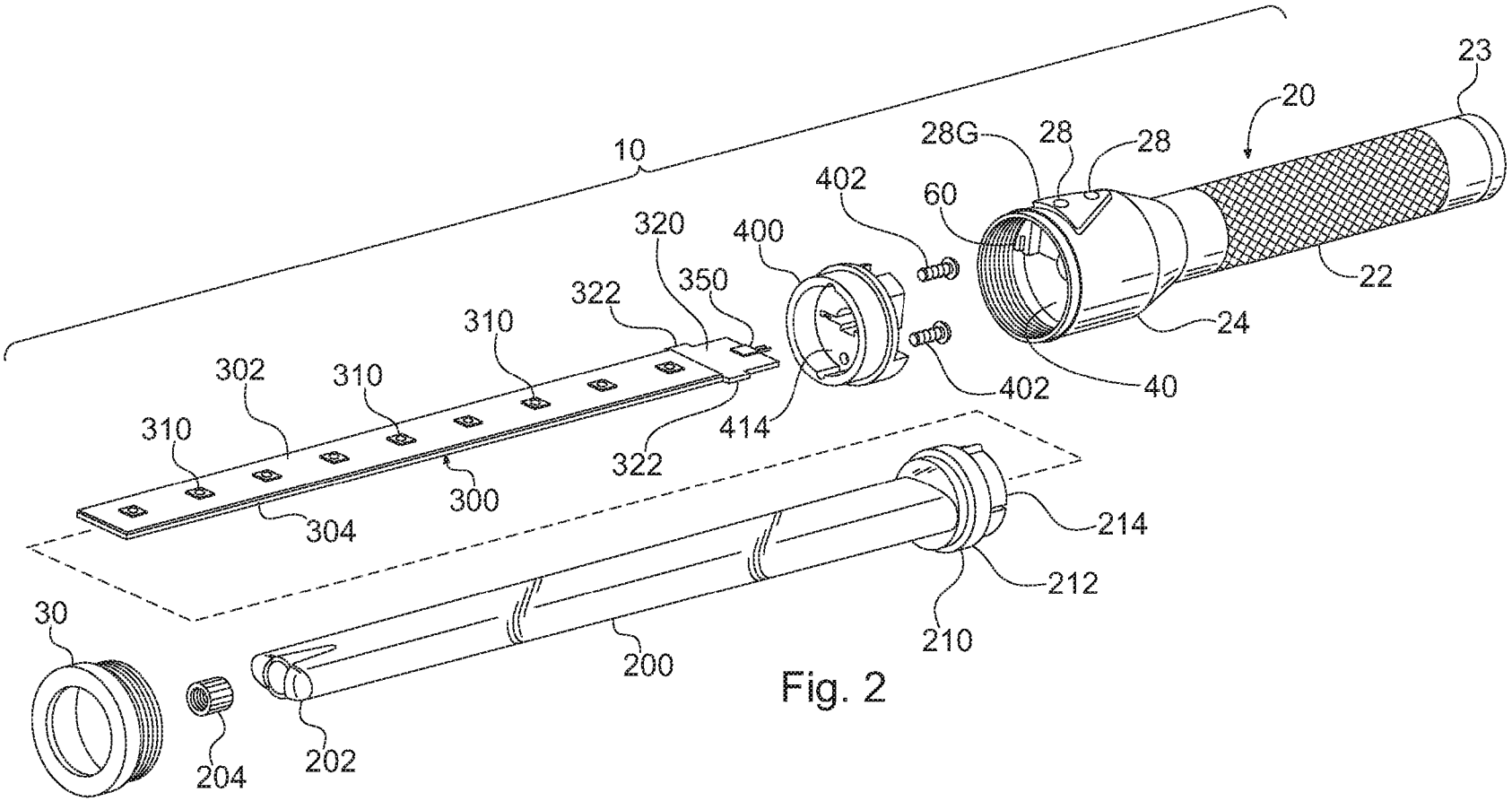
FIG. 2 is an exploded perspective view of the example embodiment of a portable light of FIG. 1.
Figure 3:
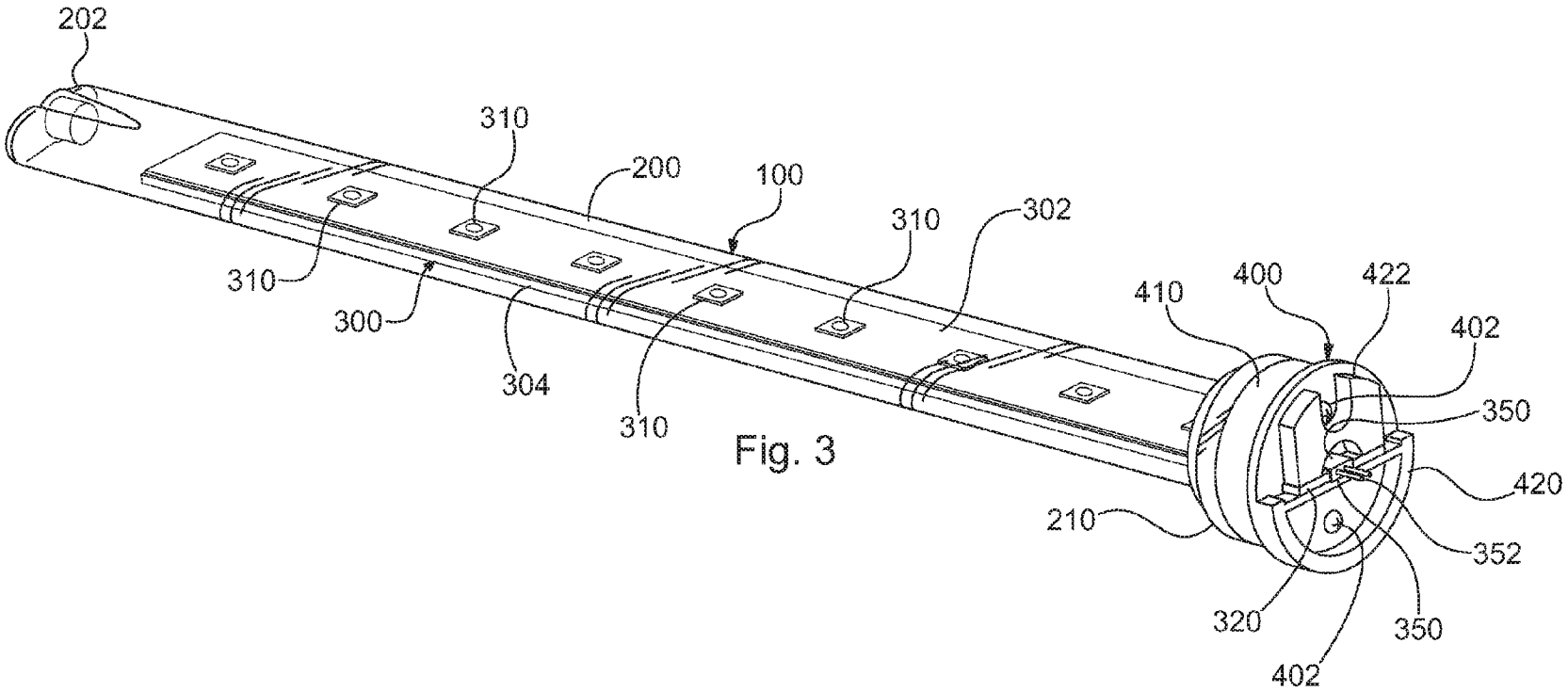
FIG. 3 is a perspective view of an example embodiment of a work light adapter portion of the example portable light of FIG. 1, as viewed from the rear.

Regarding a portable light 10, FIG. 1 is a perspective view of an example embodiment of a portable light 10, FIG. 2 is an exploded perspective view of the example embodiment of a portable light 10 of FIG. 1, and FIG. 3 is a perspective view of an example embodiment of a work light adapter portion 100 of the example portable light 10 of FIG. 1, as viewed from the rear. Light 10 comprises a light body 20 and a light source 100, e.g., a light bar 100 extending therefrom, wherein light body 20 has a forward or head end 12, 12' from which light is emitted and has a rear or tail end 14.

Light body 20 provides a housing which has a barrel portion 22 having an internal cavity into which batteries or another source of electrical power may be disposed. Access to the internal cavity is by removing the removable tail cap 23 which threads into or onto the rearward end 14 of light 10. Light body 20 has a head 24 at the forward end 12' thereof whereat a light source, e.g., light bar 100 may be attached. While head 24 may have a larger diameter than does barrel 22, barrel 22 and head 24 may be of the same diameter or may be of different diameters. Head portion 24 may enclose a switch module 40 which includes an electrical switch for controlling light source 100 that may be actuated by pressing on actuator boot 26, e.g., a rubber or other resilient cover 26, accessible on the exterior of light body 20, e.g., on the head 24 thereof, on barrel 22 thereof or at the tail end 14 thereof.

Head 24 is threaded for engaging a retainer ring 30. Where head 24 has an internal thread, as illustrated, then retainer ring 30 has a corresponding external thread, as illustrated, and where head 24 has an external thread, then retainer ring 30 has a corresponding internal thread. Retainer ring 30 may be a ring that has an inwardly directed circular flange that covers the base of light bar 100 and so retains light bar 100 in the head end 12 of light body 20, or may retain another light source therein, as may be desired. While a light source that projects a beam of light forwardly from head end 12" may be provided and be retained by ring 30, in the illustrated embodiment it is preferred that an extended light source, e.g., a light bar 100, that provides illumination over a relatively wider area, e.g., a flood light or a broader beam of light, be employed.

To that end, light bar 100 has an axially elongated relatively tubular housing 200 that is transparent or translucent for allowing light produced by plural light emitting diodes (LEDs) 310 therein to pass therethrough, thereby to provide light over a relatively wide illumination area, generally to the side in the illustrated configuration of light 10. Light emitting diodes (LEDs) 310 supported on a circuit board assembly 300 disposed interior to housing 200. Plural LEDs 310, e.g., 6-10 LEDs 310, and preferably 8 LEDs, are preferably mounted on one surface (side) of circuit board 302 of assembly 300 thereby to provide illumination over up to an about 180° spherical angle, e.g., a directed flood type of illumination. Alternatively, LEDs 310 may be mounted on both surfaces (sides) thereof so as to provide illumination in almost all directions, e.g., up to an about 360° spherical angle. Tubular housing 200 typically has an elliptical or oval cross-sectional shape so as to provide an internal cavity that is axially elongated as well as relatively wider than it is high so as to receive the elongated relatively planar circuit board assembly 300 therein. While a transparent housing 200 is illustrated in the example light bar 100, a translucent housing 200 may be employed so as to diffuse the light emitted by plural discrete LEDs 310 into a more evenly distributed flood illumination.

Elongated transparent/translucent housing 200 has a base end 210 which engages an adapter base 400 by which light bar 100 is attached to light body 20 of light 10. Base 210 of housing 200 typically has a circular ring 212 of a relatively larger diameter that fits adjacent to adapter base 400 and a circular ring 214 of relatively smaller diameter that fits into a circular recess 414 in adapter base 400. When light bar 100 is mounted to light body 20, the inward directed circular flange of retainer ring 30 overlaps and retains base 210 and adapter 400 adjacent thereto in the forward end 12' of light body 20.

Elongated circuit board assembly 300 is supported at a circuit board base 320 on which is mounted an electrical connector 350, e.g., a connector having conductive pins 352 extending away from circuit board 310 and towards light body 20, e.g., in similar configuration to that of a bi-pin incandescent lamp. Circuit board base 320 has one or more tabs 322 extending to engage adapter base 400 and assist in properly locating circuit board 300 and base 320 in adapter base 400. As will be described further below, switch module 40 of light body 20 has a corresponding electrical connector 50 that has receptacles or sockets 52 with which the pins 352 of connector 350 engage to make electrical contact when light bar 100 is mounted to light body 20.

It is noted that adapter base 400 of light bar 100 is arranged to mate with light body 20 only in a particular rotational orientation that will permit connectors 50, 350 to mate with proper relative physical positions and, where applicable, proper electrical polarity. To this end, respective raised features and/or recesses of each of the open end of light body 20 and of the adapter base 400 of light bar 100 (or another source of light mounted to adapter base 400) are complementary so as to allow the mating thereof in only one orientation, e.g., in the angular rotational orientation wherein those raised and recess features align to permit adapter base 400 to be seated in the open end of light body 20. The correspondence of these respective features and their complementarity ensure that adapter 400 will not seat if in an improper orientation. In addition, the raised features of adapter base 400 provide a degree of protection for the pins 352 of connector 350 to render them less susceptible to physical damage.

As a result, not only are the pins 352 protected against damage, and not only are the circuitry and LEDs of light bar 100 protected against voltage of the wrong polarity, but the orientation of light bar 100 which produces directional illumination is also predetermined relative to light body 20. Thus, the illumination produced by light 10 will be in a desired direction relative to light body 20 and so the controls, e.g., switch actuator 26, thereof will be in a desired orientation relative to the direction of illumination, thereby to make light 10 easier and more convenient for a user to operate and use.

Figure 6:
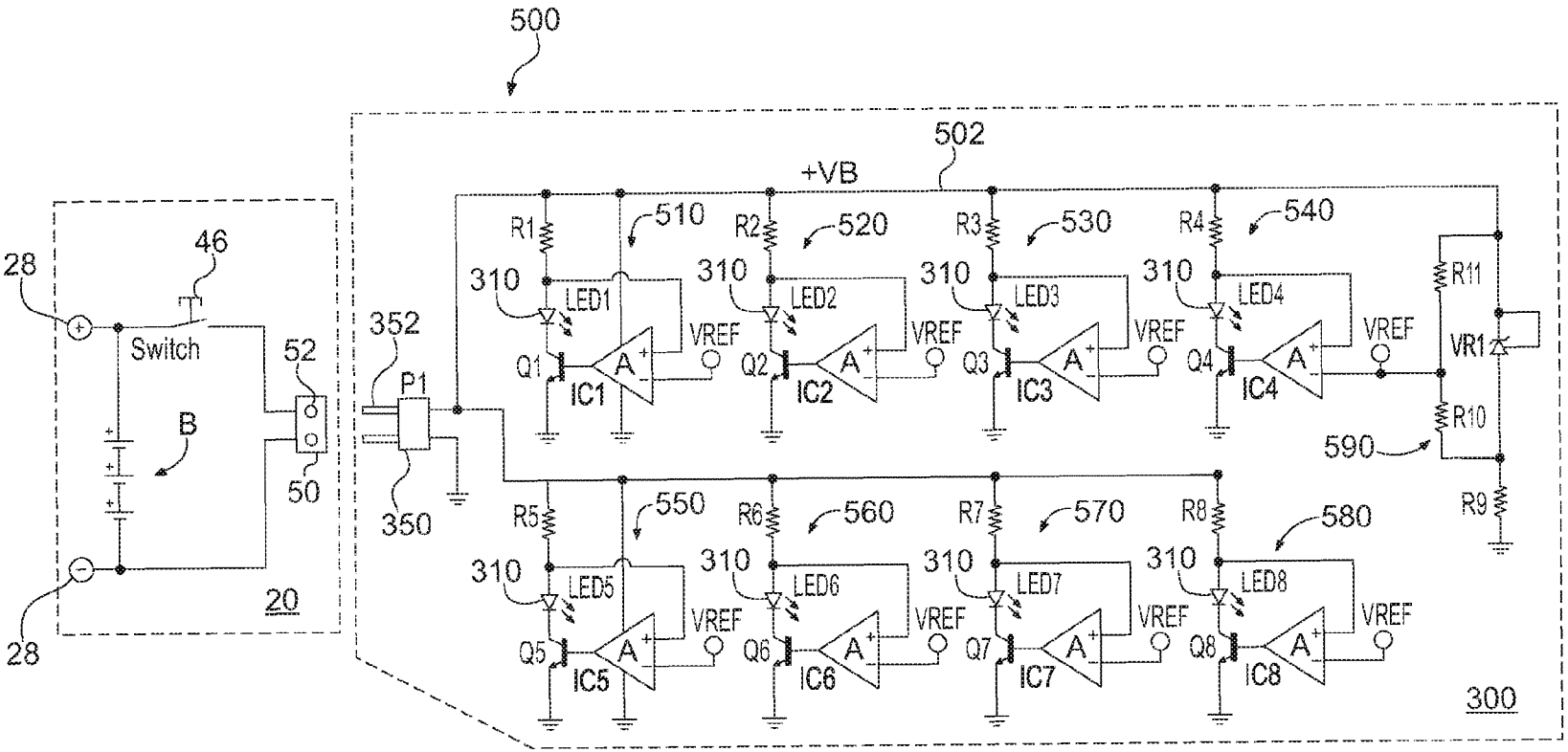
FIG. 6 is a schematic circuit diagram of an example embodiment of an electronic circuit suitable for use in the work light adapter of FIGS. 2 and 3.

Elongated circuit board assembly 300 includes a plurality of LEDs 310 mounted to one surface (side) thereof which includes electrical conductors that conduct electrical power thereto for causing LEDs 310 to produce light. Circuit board 300 further includes electronic circuitry 500 for producing from the voltage and current received at connector 350 (from connector 50 of light body 20) the proper voltage and/or current levels that when applied to LEDs 310 cause LEDs 310 to produce the desired light output, e.g., light at the desired brightness or intensity. While circuitry 500 may be relatively simple, e.g., one or more resistors of a value for setting a desired voltage and current for LEDs 310, circuitry 500 typically and preferably includes a current and/or voltage regulator circuit that provides a desired level of voltage and/or current to LEDs 310. Optionally, a DC converter may be provided to convert the received power, e.g., the battery voltage of the batteries disposed in light body 20, to a desired voltage that is applied to LEDs 310 or to a desired current that flows through LEDs 310, or both. One example embodiment of an electrical circuit 500 is illustrated in FIG. 6.

Also optionally, electronic circuitry 500 may also include a controller and/or processor, e.g., a microprocessor or micro controller, that is responsive to the timing, duration and/or sequencing of the voltage received at connector 350 for selecting an operating mode or condition of LEDs 310 of light bar 100, e.g., momentarily ON, continuously ON, OFF, blinking, flashing, one or more or all of LEDs ON, and the like, and may also allow the dimming and/or un-dimming of the light output of LEDs 310. The voltage at connector 50, 350 is typically directly responsive to operation of the electrical switch of light module 40 when it is actuated via actuators 46, 26, either momentarily, continuously, for a defined time, and/or in a sequence of actuations of a defined number and/or timing.

Adapter base 400 of light bar 100 is a circular member configured on one circular side to receive the base 210 of light housing 200 and on the other side to engage in the forward end 12' of light body 20 so as to engage switch module 40 therein and in particular, to make electrical connection thereto for enabling LEDs 310 of light bar 100 to be powered by the batteries or other electrical power source on light housing 20 and to be controlled by an electrical switch of switch module 40 responsive to actuation via actuator 26 on the exterior of light body 20.

Where light body 20 is a light body of a portable light that included an incandescent lamp that mounted via pins to the electrical connector 50 of light module 40, electrical elements necessary and/or desired to apply suitable voltage and or current to LEDs 310 may be provided on circuit board 300 or on adapter base 320 thereof. Such electronic elements may include one or more resistances (e.g., resistors) for setting an approximate current flowing through ones of LEDs 310, or may include more complex electronic circuitry to control the level and waveform of the current and/or voltage that is applied to LEDs 310, and may even include a processor or controller responsive to the electrical power applied via connector 350 for controlling the operating mode and/or operating level of one or more of LEDs 310.

Where light body 20 is intended to contain a battery or batteries that are rechargeable, external contacts 28 are provided for connecting to corresponding electrical charging contacts of a battery charging device (not shown). Light body 20 may also include a shaped raised guide 28G, e.g., a triangular guide 28G, on which contacts 28 are disposed. Guide 28G assists in guiding light body 20 into the charging receptacle of the battery charging device in the proper orientation for making electrical connections between the charging contacts 28 of light body 20 and the corresponding contacts of the charging device.

One example of a light having a light body 20 and guide 28G of this sort and of a charging device therefor may be found in U.S. Pat. No. 5,432,689 entitled 'FLASHLIGHT AND RECHARGING SYSTEM THEREFOR" which was issued to Raymond L. Sharrah et al on Jul. 11, 1995, which is hereby incorporated herein by reference in its entirety. Examples of this type of light may be found in the STINGER® family of incandescent lights which is sold by Streamlight, Inc. of Eagleville, Pa.

Because LEDs 310 generate heat in operation, circuit board assembly 300 provides for the conduction of such heat away from LEDs 310 so as to maintain LEDs 310 at suitable operating temperatures. For relatively modest levels of heat generation, electrical conductors and/or metal areas on the surface or surfaces of circuit board 300 may suffice to remove sufficient heat from LEDs 310 and circuit board 300. For higher levels of heat generation, additional provision for heat removal may need to be made. For example, circuit board 300 may include an insulating circuit board 302 of electrically insulating material with a pattern of electrical conductors thereon that is mounted to a thermally conductive sheet, e.g., an aluminum sheet 304, that serves as a heat sink therefor. Circuit board 300 and/or 302 may have heat conductive vias, heat conductive surface areas, and/or other heat conducting features thereon. Further, circuit board 300 preferably includes electronic components thereon for establishing a predetermined level of current and/or voltage for each of LEDs 310.

Light bar 100 may have eight LEDs 310 on circuit board 300, 302 as in the example illustrated, or may have a greater or lesser number of LED light sources 310, and LEDs 310 need not be evenly spaced as illustrated, but may be unevenly spaced so as to provide illumination that is brighter in a portion of its beam. Further, light bar 100 may be longer or shorter than the example illustrated. LED light sources 310 need not be arrayed in a line as illustrated, and may be arrayed in plural lines or not in lines as may be appropriate and/or convenient, or as may be desired for shaping the beam of light produced thereby. Reflectors may be provided for the LEDs 310, or housing 200 may be shaped so as to serve as a beam shaping lens, as may be desired in any given embodiment.

Optionally, but preferably, light bar 100 may include a mounting member 204 at or near the distal tip 202 thereof to which various accessories, e.g., a hook, magnet, flexible retaining member or other mounting device may be attached. The hook, magnet, flexible retaining member or other mounting device attached to mounting device 204 can be attached to a convenient object to which a user of light 10 may desire to attach light 10, e.g., to a vehicle, building, wall, tool, or other fixed or mobile object. Typically, mounting member 204 may be a threaded bushing 204, as illustrated, or may be another receptacle or projection to which an accessory, e.g., a hook, magnet, flexible retaining member or other mounting device, may be fastened, e.g., threaded into or snapped into. Bushing 204 may be pressed into housing 200, may be heat pressed into housing 200, or may be molded therein, or may be otherwise fastened thereto.

Figure 4A:
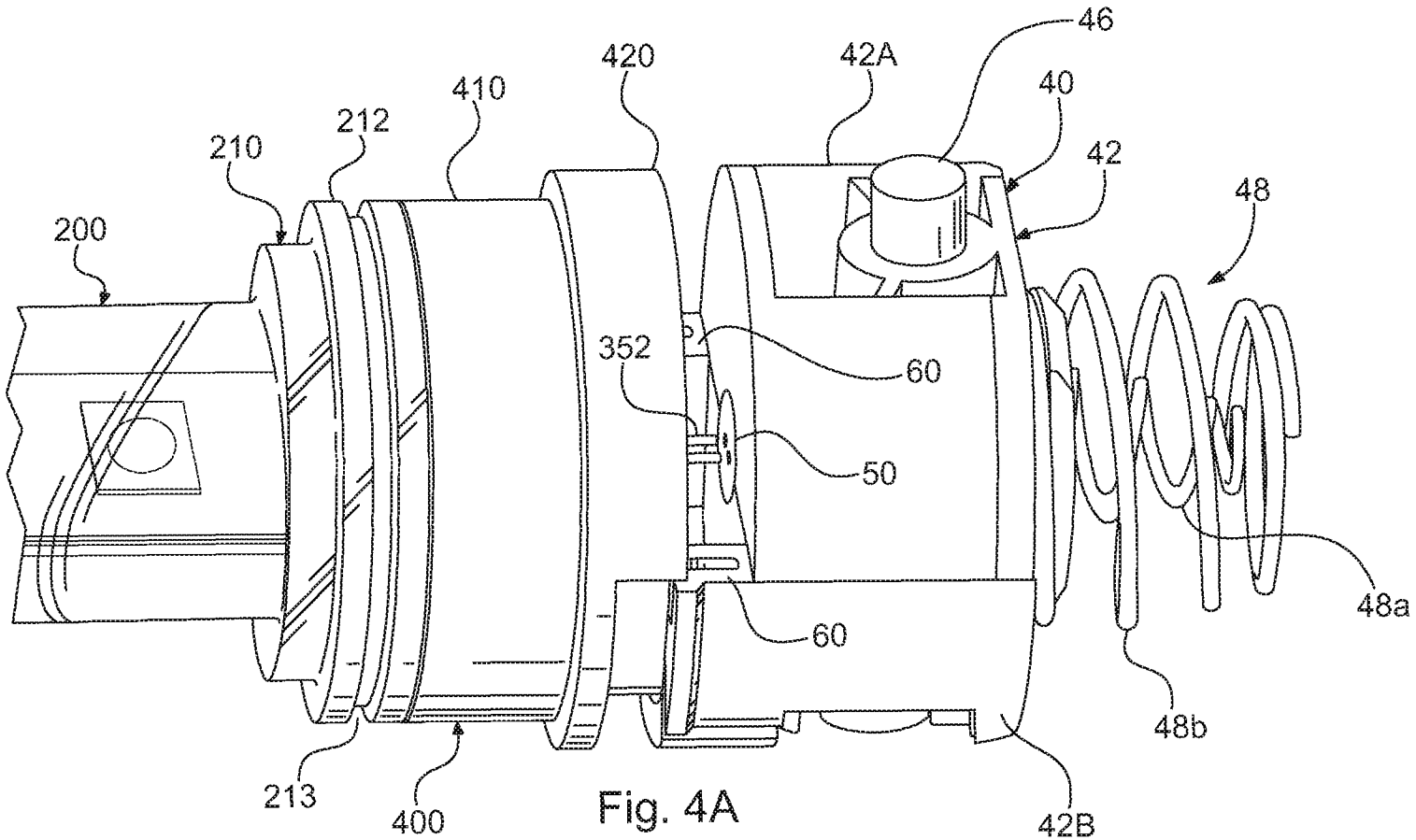
FIG. 4 includes FIG. 4A which is a side perspective view and FIG. 4B which is an exploded perspective view of the interface between example embodiments of the example portable light of FIG. 1 and the example work light adapter therefor of FIG. 3.
Figure 4B:
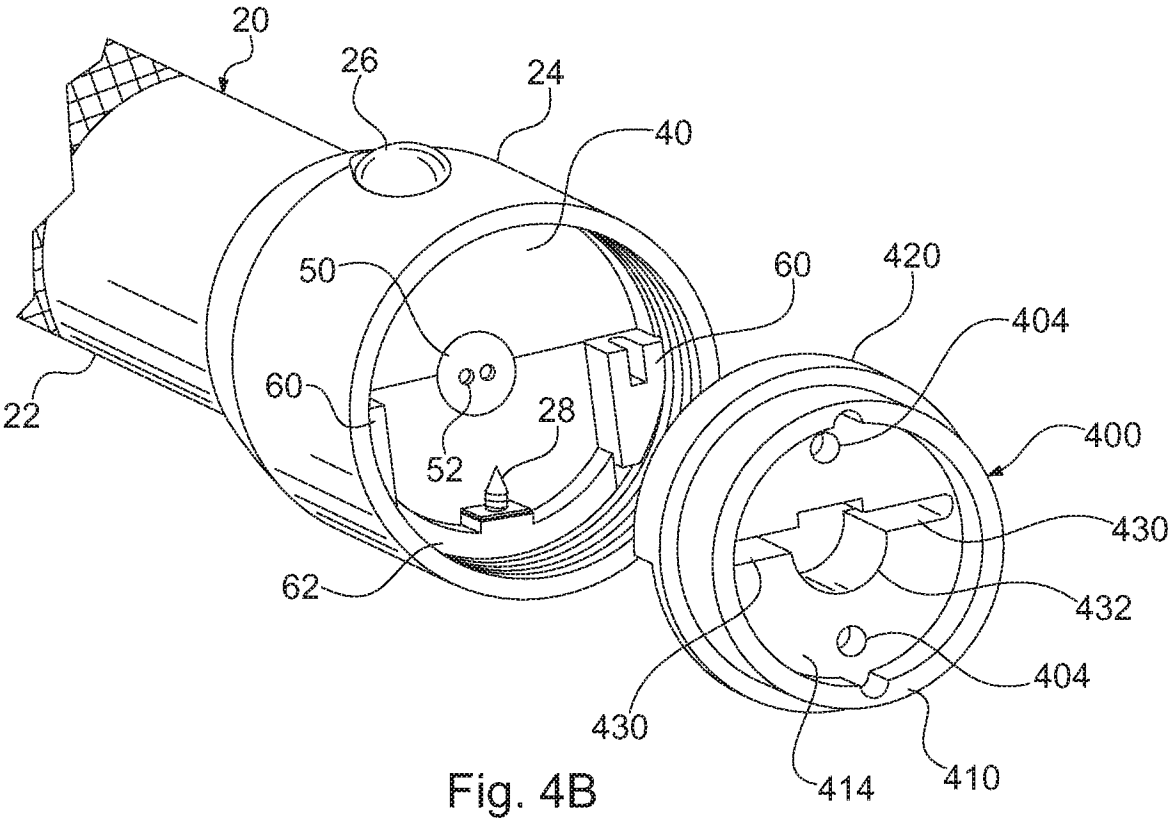

FIG. 4 includes FIG. 4A which is a side perspective view and FIG. 4B which is an exploded perspective view of the interface between example embodiments of the example light body 20 of portable light 10 of FIG. 1 and the example work light adapter 100 therefor, and FIG. 4 should be considered in conjunction with FIG. 3. The forward end 12' of light body 20 has switch module 40 disposed therein where it is retained by fasteners 28 which serve not only to secure switch module 40 in light body 20, but also serve as electrical charging contacts 28 for providing electrical connections between the electrical circuitry of light 10 and a battery charger (not shown) into which light 10 may be placed.

The interface between light body 20 and light bar 100 is intended to permit the making of electrical connection between respective electrical connectors 50, 350 of light bar 100 and light body 20 in a predetermined manner. Specifically, because in one example of light body 20 the two connections of connector 50 are electrically polarized and in one example of light bar 100 the two connections of connector 250 are intended to receive electrical voltage of a particular polarity, it is desired that the connections between connectors 50, 250 be made in a predetermined polarity so the proper electrical polarity is provided.

To this end, adapter base 400 of light bar 100 has one or more raised bosses 420, 422 that extend in the axial direction and that are complementary to one or more raised bosses 60, 62 on switch module 40 of light body 20 that extend in the axial direction at the open end 12' of light body 20 so that adapter base of light bar 100 can be seated in the open end 12' of light body 20 only when light body 20 and light bar 100 are in a particular relative angular orientation wherein the respective raised bosses 60, 62, 420, 422 do not interfere. Only in this particular relative angular orientation can the pins of one of connectors 50, 250 enter the sockets of the other of connectors 50, 250, thereby to make connections therebetween, e.g., with the desired electrical polarity, e.g., can the pins 352 of connector 350 of light bar 100 enter into the sockets 52 of corresponding connector 50 of light body 20.

By way of example, the one or more raised bosses 60, 62 that extend axially toward the open end of light body 20 in an asymmetric pattern define a curved boss 60, 62 over an angle less than or equal to about 180° and the one or more raised bosses 420, 422 of adapter base 400 that extend into the open end 12' of light body 20 define a curved boss 420, 422 over an angle complementary to that of the curved boss 60, 62 of light body 20. The relative angular alignment necessary for adapter 400 to be seated in light body 20, wherein the connectors 50, 350 can mate without damage to sockets/pins 52, 352 thereof may be only a few degrees of angular rotation, e.g., perhaps as little as about 5° or less, and so adapter 400 will not seat over almost all of the relative rotational angles therebetween, e.g., perhaps up to about 355° or more.

In the example light body 20 illustrated, raised bosses 60, 62 are typically molded as part of the switch housing 42 disposed in light body 20, but may be otherwise provided. In this example, switch module 40 of light body 20 includes a housing or body 42 that includes a top portion 42A and a bottom portion 42B that mate together. Module housing portion 42A has an electrical switch therein having a switch actuator 46 that extends radially to be disposed adjacent actuator boot 26 for being actuated from exterior light 10. Connector 50 is disposed between housing portions 42A, 42B and has a pair of sockets 52 therein that receive pins 352 of connector 350. Housing portion 42B has a pair of spaced apart raised bosses 60 extending axially therefrom in the direction towards adapter base 400, and has electrical connections 48, e.g., coaxial helical springs 48A, 48B, extending rearwardly for making electrical connection to a battery or other electrical power source that is disposed in barrel 22 of light body 20.

Connector 50 may have pins and connector 250 may have sockets, as illustrated, or may have another configuration. Bosses 60, 420 are raised axially by a sufficient dimension so as to at least partially seat, as illustrated in FIG. 4A, before any electrical connection is made between connectors 50, 250, thereby to assure that light body 20 and light bar 100 are in the proper relative angular position before any electrical connection is made by connectors 50, 250 between the respective electrical circuits of light body 20 and of light bar 100.

It is noted that only one raised boss need be provided on each part to obtain the desired result of being able to mate light bar 100 into light body 20 only in the desired unique relative angular position, and so, e.g., circular raised bosses 60, 420 alone are sufficient to achieve this end. Raised bosses 62, 422 may further be provided to further define the permissible mating of light bar 100 and light body 20. While raised bosses 60, 62 of light body 20 are complementary to raised boss 422 of adapter base 400, they do not define a single unique angular mating position as do bosses 60, 420. Raised boss 422 includes cutouts providing clearance for connector 250 and for the tip of contact fastener 28.

Adapter base 400 has a slot 430 for receiving the LED circuit board 300 of light bar 100 therein. The central part of slot 430 may be through adapter base 400 and the ends opposing thereof may not be through, but may be blind, to provide a shoulder against which the tabs 322 of circuit board base 320 are adjacent. Preferably, slot 430 includes a recess for connector 350 and is offset from center of adapter base 400 so that the pins 352 of connector 350 mounted to circuit board base 320 are centered and aligned for mating with the sockets 52 of connector 50 of light body 20. The dimensions of the thickness of circuit board base 320 and of the offset of slot 430 are selected so that both the pins of connector 350 and the LED circuit board 300 are substantially centered relative to light body 20 and light bar 100 and housing 200 thereof.

It is seen that larger diameter ring 212 of tubular housing 200 of light bar 100 is adjacent the forward facing surface of circular ring base 410 of adapter base 400. Circular ring 212 may have a circumferential groove 213 therein for receiving an O-ring for providing a seal when retainer ring 30 is in place retaining light bar 100 to light body 20. In addition, an O-ring may be provided as a seal between retainer ring 30 and light body 20.

Figure 5A:
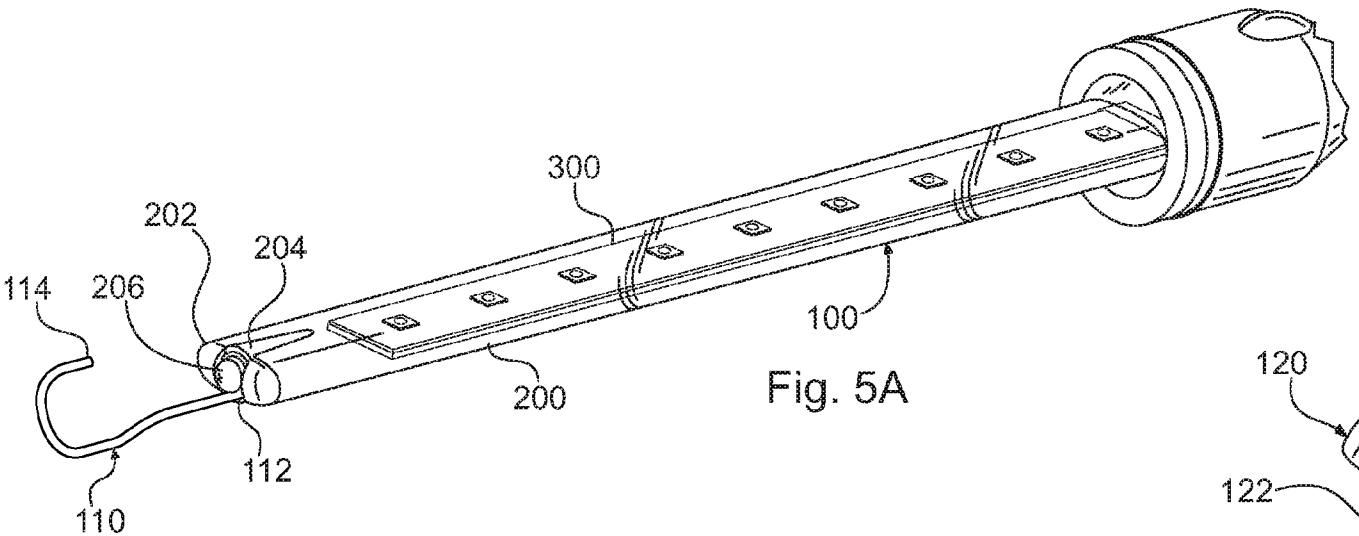
FIG. 5 includes FIGS. 5A and 5B which are perspective views of an example hanger end attachment and of an example flexible retaining member end attachment, respectively, for the example light of FIG. 1.
Figure 5B:
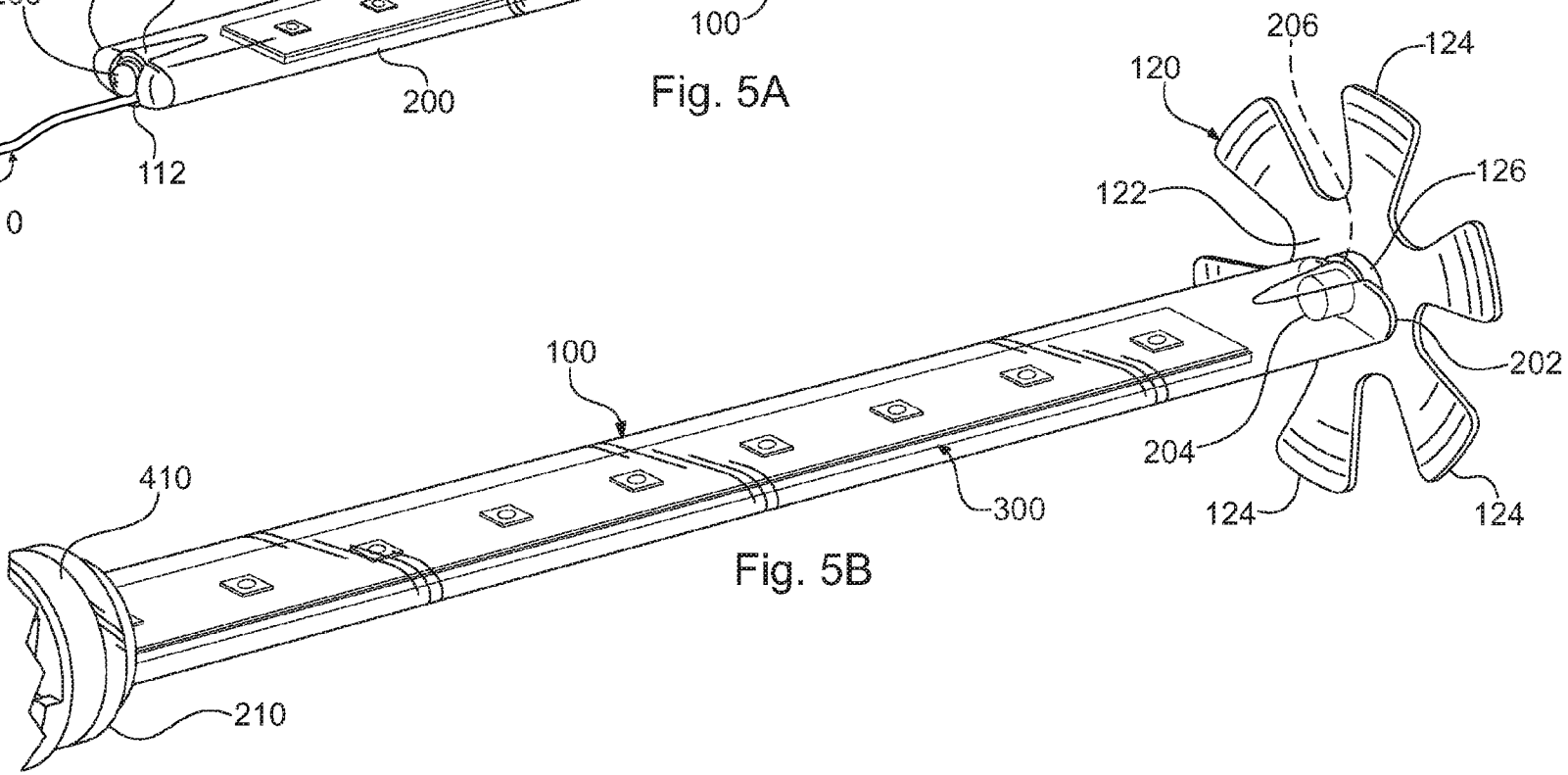

FIG. 5 includes FIGS. 5A and 5B which are perspective views of an example hanger end attachment 110 and of an example flexible retaining member end attachment 120, respectively, for the example light of FIG. 1. Example hanger end attachment 110 and example flexible retaining member end attachment 120, are but examples of various devices that may be provided for suspending light 10 from an object to render light 10 more convenient and useful in any given situation where light is to be directed in a desired direction.

Hanger attachment 110 of FIG. 5A includes an attachment end portion 112 formed in a ring that is retained on the end 12 of light bar 100 and a hanger end 114 formed into the shape of a hook 114, whereby light 10 may be hung from or other wise attached to an object. Attachment end ring 112 may be retained on housing 200 by a headed fastener 206 having a shank that passes through the ring 112 and into bushing 204 of housing 200. Preferably ring 112 is rotatable on fastener 206, e.g., about the shaft thereof, so that hanger 110 and light 10 are rotatable relative to the hanger end portion 114 and so light 10 may be positioned to direct light in a desired direction.

Hanger end portion 114 is formed in the shape of a hook 114 so as to be hangable from any suitable object, e.g., a peg, hole, vehicle part, pipe, conduit, nail and the like, as may be convenient in any given situation. Preferably hanger portion 114 is offset so that hanger portion 114 and ring portion 112 are substantially aligned so as to be aligned with the longitudinal centerline of housing 200 and bushing 204 therein, so that light 10 will tend to hang substantially vertically, if free of obstruction. Hook 114 may be curved or have segmented portions or be in another shape, as may be convenient and/or aesthetic, and may have more than one hook as in the example illustrated.

Flexible retaining member end attachment 120 of FIG. 5B may be a generally planar disk or wheel or propeller shaped member that can be placed or inserted into an available space and be retained therein so as to support light 10 therefrom. For example, when working on vehicles and other machinery, there is often no convenient way to suspend or support light 10 by its hanger attachment 110, but there may be places, e.g., nooks and crannies, into which a flexible deformable member 120 may be pressed for being retained therein by the force of its flexible fingers 124 seeking to return to their undeformed shape. Light 10 and member 120 may be removed therefrom by pulling on light 10 to cause fingers 120 to again deform, but in a way that allows member 120 to be removed from the space in which it was retained.

Member 120 typically has a generally circular center disk portion 122 from which extend a plurality of axially flexible radial fingers 124 having remote ends defining a substantially circular periphery. Preferably disk 122 is thin relative to its diameter so as to be flexible in an axial direction while offering resistance to substantial deformation. Disk portion 122 may have a thicker central region 126 through which is a hole for receiving the shank of a fastener (not visible) that attaches member 120 to bushing 204 of light bar 100, similarly to fastener 206 attaching hanger attachment 110 thereto. Member 120 may be sized, e.g., in thickness, so as to rotate freely on its fastener 206, to offer resistance to rotation thereon or to be restrained from being rotatable thereon, whereby light 10 may be rotated for directing illumination in a desired direction.

Flexible fingers 124 of flexible member 120 preferably are thin relative to their length and width so as to be flexible in the axial direction, e.g., to offer relatively lower resistance to their being bent axially than to their being deformed in the plane of member 120. This allows member 120 to be inserted into a space smaller than the diameter defined by the tips of fingers 124 of member 120, and then to be withdrawn therefrom. Preferably fingers 124 are slightly curved from the plane of member 120 so that their tips are closer to light bar 100, thereby to make their insertion into a small space somewhat easier.

Two or more wheel like flexible retaining members 120 may be utilized on a light 10, e.g., preferably secured to light bar 100 by the same fastener 206 with their disk portions abutting and with their fingers preferably curving away from each other axially. Alternatively, a flexible retaining member 120 may have a generally spherical central portion 122 and may have a plurality of flexible fingers 124 extending radially therefrom in many directions, thereby for the tips of fingers 124 to define a surface that is a substantial part of a sphere, or at least a hemisphere. Also alternatively, bushing 204 may have plural axial spring fingers and member 110, 120 may have a shaft extending therefrom that has an enlarged region, e.g., a ball at the end thereof, that can be inserted into bushing 204 and be grasped by the axial fingers of bushing 204, thereby to retain member 110, 120 on housing 200 of light bar 100.

FIG. 6 is a schematic circuit diagram of an example embodiment of an electronic circuit 500 suitable for use in the work light adapter 100 of FIGS. 2 and 3. In the part of circuit 500 disposed in light body 20, when switch 46 is actuated to be connected (closed), batteries B provide electrical power for light 10 to sockets 52 of connector 50, and may be connected to a battery charger via connections 28*e* and 28*e* each of which includes a fastener 28. Typically, conductors of the part of circuit 500 disposed in light body 20 are provided by metal conductors of light module 40.

In the part of circuit 500 disposed in light bar 100, the components thereof are disposed on circuit board 300, e.g., on electronic circuit board 302 which is disposed adjacent to heat sink 304. Each of LEDs 310 identified as LED1-LED8, is operated at a predetermined current level by a respective amplifier A and transistor Q circuit 510-580. Each of circuits 510-580 receives a reference voltage VREF which is provided by reference circuit 590. Circuit 590 includes a voltage reference source VR1, e.g., a Zener diode or other suitable source of a fixed predetermined voltage, that is biased by resistor R9 to provide a fixed predetermined voltage. The fixed predetermined voltage across fixed voltage source VR1 is reduced by a voltage divider formed by resistors R10, R11 to provide the fixed predetermined reference voltage VREF with respect to the voltage +VB on conductor 502.

Each of current control circuits 510-580 includes a respective amplifier A that receives at its inverting input A− a reference voltage VREF and receives at its non-inverting input A+ a feedback voltage produced by the current flowing through its respective LED 310 (one of LED1-LED8) also flowing through its respective feedback resistor R1-R8. If the current flowing in the LED 310 is too high or too low, then an error signal is developed at inputs A+ and A− of amplifier A that causes its output applied to control a respective transistor T1-T8 to decrease or increase the current flowing therethrough so as to return and maintain the current flowing in the respective LED 310 at the desired predetermined level.

In a typical embodiment, light body 20 may be the light body of a light of the STINGER® family of incandescent lights sold by Streamlight, Inc. of Eagleville, Pa., and may be of a suitable metal or plastic, e.g., of aluminum or of nylon plastic. Tubular housing 200 may be of polycarbonate, or another transparent or translucent plastic, adapter base 400 may be of acetal, or nylon, or another transparent or translucent plastic, and retainer ring 30 may be of a suitable metal or plastic, e.g., of aluminum, or nylon. Bushing 204 may be of aluminum, brass or other suitable metal or of a plastic. Hanger or hook 110 may be of a suitable metal or plastic, e.g., of aluminum, steel, nylon, and the like, and flexible retaining member 120 may be of a suitable flexible plastic, e.g., of silicone, urethane, rubber, neoprene, and the like.

Light body 20 may contain a battery B that includes three rechargeable nickel-cadmium (Ni—Cd) cells producing about 3.5-3.6 volts when fully charged, which cells are preferably provided as a single packaged battery unit, as in the STINGER® family of incandescent lights available from Streamlight, Inc. of Eagleville, Pa. Connector 50 is typically a two socket or two receptacle connector of the sort utilized to receive a bi-pin incandescent lamp, e.g., the xenon lamp used in the STINGER® lights. Circuit support 300 may have a fiberglass, FR4 or other electrically insulating electronic circuit board 302 and a heat sink 304 of any suitably heat conductive material, e.g., aluminum, brass, copper, thermally loaded plastic, and the like.

A portable light 10 and light source adapter 100, 400 may comprise: a light body 20 having an open end 12' for receiving a light source 100 therein, the open end exposing a face 40 including one or more raised bosses 60, 62 extending axially toward the open end in an asymmetric pattern and one or more electrical connections 50, 52, the light body 20 having a cavity for receiving a source of electrical power therein and optionally including an electrical switch for selectively energizing at least one of the electrical connections 50, 52; a light source 100 including an adapter base 400 disposed in the open end of the light body 20, the adapter base 400 having one or more raised bosses 420, 422 extending into the open end of the light body 20, the one or more raised bosses 420, 422 being in an asymmetric pattern that is complementary to the asymmetric pattern of the one or more raised bosses 60, 62 extending from the face 40 of the light body 20 so that the adapter base 400 cannot seat adjacent the face 40 unless their complementary raised bosses 60, 62, 420, 422 are in a predetermined rotational relationship for mating; the adapter base 400 including one or more electrical connections 350, 352 that are located to mate with the one or more electrical connections 50, 52 on the exposed face 40 only when the adapter base 400 is seated adjacent the face in the predetermined rotational relationship for mating; the light source 100 including a source of illumination 300, 310 electrically connected to the one or more electrical connections 350, 352 of the adapter base 400; and a retainer 30 for retaining the light source 100 disposed in the open end of the light body 20 with the adapter base 400 seated adjacent the face 40 in the predetermined rotational relationship for mating. The light source 100 may comprise an elongated light bar 100 including: an elongated tubular transparent or translucent housing 200 extending from the adapter base 400; a plurality of light emitting diodes 310 disposed on an elongated support 300 disposed in the elongated tubular housing 200. The light emitting diodes may be disposed on one surface of the elongated support 300 for directing light to the side of the tubular housing 200 when energized. The elongated support 300 may include an electrical circuit board 302 having conductors thereon for connecting the plurality of light emitting diodes 310 to the one or more electrical connections 350, 352 of the adapter base 400. The electrical circuit board 302 may include an electronic circuit 500 for controlling the voltage applied to and/or the current flowing through the plurality of light emitting diodes 310. The elongated support 300 may include: an electrical circuit board 302 having conductors thereon for connecting the plurality of light emitting diodes 310 to the one or more electrical connections 350, 352 of the adapter base 400; and a heat conductive member 304 adjacent the electrical circuit board 302 and thermally coupled thereto. The retainer 30 may include a retainer ring 30 having threads thereon for engaging threads at the open end of the light body 20. The one or more raised bosses 60, 62 that extend axially toward the open end 12' of the light body 20 in an asymmetric pattern define a curved boss 60, 62 over an angle of less than about 180° and the one or more raised bosses 420 of the adapter base 400 that extend into the open end of the light body 20 define a curved boss over an angle complementary to that of the curved boss 60, 62 of the light body 20.

A light source adapter 100, 400 for a portable light 10, the portable light 10 may comprise a light body 20 having an open end 12' for receiving a light source 100 therein, the open end exposing a face 40 including one or more raised bosses 60, 62 extending axially toward the open end 12' in an asymmetric pattern and one or more electrical connections 560, 52, the light body 20 having a cavity for receiving a source of electrical power therein and optionally including an electrical switch for selectively energizing at least one of the one or more electrical connections 50, 52; the light source adapter 100, 400 comprising: a light source 100 including an adapter base 400 disposable in the open end of the light body 20, the adapter base 400 having one or more raised bosses 420, 422 for extending into the open end of the light body 20, the one or more raised bosses 420, 422 being in an asymmetric pattern that is complementary to the asymmetric pattern of the one or more raised bosses 60, 62 extending from the face 40 of the light body 20 so that the adapter base 400 cannot seat adjacent the face 40 unless their complementary raised bosses 60, 62, 420, 422 are in a predetermined rotational relationship for mating; the adapter base 400 including one or more electrical connections 350, 352 to mate with the one or more electrical connections 50, 52 on the exposed face 40 only when the adapter base 400 is seated adjacent the face 40 in the predetermined rotational relationship for mating; the light source 100 including a source of illumination 300, 310 electrically connected to the at least two electrical connections 350, 352 of the adapter base 400. The light source 100 may comprise an elongated light bar 100 including: an elongated tubular transparent or translucent housing 200 extending from the adapter base 400; a plurality of light emitting diodes 310 disposed on an elongated support 300 disposed in the elongated tubular housing 200. The light emitting diodes may be disposed on one surface of the elongated support for directing light to the side of the tubular housing 200 when energized. The elongated support 300 may include an electrical circuit board 302 having conductors thereon for connecting the plurality of light emitting diodes 310 to the one or more electrical connections 350, 352 of the adapter base 400. The electrical circuit board 302 may include an electronic circuit 500 for controlling the voltage applied to and/or the current flowing through the plurality of light emitting diodes 310. The elongated support 300 may include: an electrical circuit board 302 having conductors thereon for connecting the plurality of light emitting diodes 310 to the one or more electrical connections 350, 352 of the adapter base 400; and a heat conductive member 304 adjacent the electrical circuit board 302 and thermally coupled thereto. The light source adapter 100, 400 for a portable light 10 may further comprise: a retainer 30 for retaining the light source 100 disposed in the open end 12' of the light body 20 with the adapter base 400 seated adjacent the face 40 in the predetermined rotational relationship for mating. The retainer 30 may include a retainer ring 30 having threads thereon for engaging threads at the open end of the light body 20. The one or more raised bosses 60, 62 that extend axially toward the open end 12' of the light body 20 in an asymmetric pattern define a curved boss 60, 62 over an angle of less than about 180° and the one or more raised bosses 420 of the adapter base 400 that extend into the open end of the light body 20 define a curved boss 420 over an angle complementary to that of the curved boss 60, 62 of the light body 20.

A portable light 10 and light source adapter 100, 400 may comprise: a light body 20 having an open end for receiving a light source 100 therein, the open end having an exposed a face including one or more features 60, 62 in an asymmetric pattern and one or more electrical connections 50, 52, the light body 20 having a cavity for receiving a source of electrical power therein and optionally including an electrical switch for selectively energizing at least one of the electrical connections 50, 52; a light source 100 for emitting light in a predetermined direction and including an adapter base 400 disposed in the open end of the light body 20, the adapter base 400 having one or more features 420, 422 complementary to the features 60, 62 of the light body 20 in an asymmetric pattern that is complementary to the asymmetric pattern of the one or more features 60, 62 of the face of the light body 20 so that the adapter base 400 cannot seat adjacent the face unless their complementary features are in a predetermined rotational relationship for mating. The light source 100 when disposed in the light body 20 can emit light in the predetermined direction relative to the light body 20. The adapter base 400 may include one or more electrical connections 350, 352 that are located to mate with the one or more electrical connections 50, 52 on the exposed face only when the adapter base 400 is seated adjacent the face in the predetermined rotational relationship for mating. The light source 100 may include a source of illumination 300, 310 electrically connected to the one or more electrical connections 350, 352 of the adapter base 400 for emitting light in the predetermined direction. The portable light 10 and light source adapter 100, 400 may further comprise a retainer 30 for retaining the light source 100 in the open end of the light body 20 with the adapter base 400 seated adjacent the face in the predetermined rotational relationship for mating. The retainer 30 may include a retainer ring 30 having threads thereon for engaging threads at the open end of the light body 20. The light source 100 may comprise an elongated light bar 100 which may include: an elongated tubular transparent or translucent housing 200 extending from the adapter base 400; and a plurality of light emitting diodes 310 disposed on an elongated support 300 disposed in the elongated tubular housing 200 for emitting light in the predetermined direction. The light emitting diodes 310 may be disposed on one surface of the elongated support 300 for directing light to the side of the tubular housing 200 when energized. The elongated support 300 may include an electrical circuit board 302 having conductors thereon for connecting the plurality of light emitting diodes 310 to the one or more electrical connections 350, 352 of the adapter base 400. The electrical circuit board 302 may include an electronic circuit 500 for controlling the voltage applied to and/or the current flowing through the plurality of light emitting diodes 310. The elongated support 300 may include: an electrical circuit board 302 having conductors thereon for connecting the plurality of light emitting diodes 310 to the one or more electrical connections 350, 352 of the adapter base 400; and a heat conductive member 304 adjacent the electrical circuit board 302 and thermally coupled thereto. The one or more features 60, 62 of the light body 20 may include one or more raised bosses that extend axially toward the open end of the light body 20 in an asymmetric pattern define a curved boss over an angle of less than about 180° and the one or more features 420, 422 of the light source 100 may include one or more raised bosses of the adapter base 400 that extend into the open end of the light body 20 define a curved boss 60, 62 over an angle complementary to that of the curved boss 420, 422 of the light body 20.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "front," "rear," "side," "top," "bottom," "forward," "backward," "under" and/or "over," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

Further, what is stated as being "optimum" or "deemed optimum" may or may not be a true optimum condition, but is the condition deemed to be desirable or acceptably "optimum" by virtue of its being selected in accordance with the decision rules and/or criteria defined by the designer and/or applicable controlling function, e.g., the operating points of LEDs 310 and/or circuit 500.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device.

While the present invention has been described in terms of the foregoing example embodiments, variations within the scope and spirit of the present invention as defined by the claims following will be apparent to those skilled in the art. For example, while an example light source 100 may include a light bar 200 extending from an adapter base 400, e.g., providing light directionally in a direction other than axially forward from light body 20, other sources of light may be provided and attached to an adapter base 400. Examples include a light emitting diode disposed at the base of a reflector for projecting a formed or shaped beam of light in a generally forward direction, e.g., as a more tightly formed or spot beam, rather than the generally sideways directed relatively diffuse or flood illumination provided by light bar 100 of the illustrated example embodiment.

While the retainer 30 is preferably a ring 30, e.g., a retainer ring 30, as illustrated, retainer 30 may include screws, pins, clips, and/or other fasteners that serve to retain adapter 100 in light body 20.

In the example light body 20 illustrated, bosses 60, 62 may be part of the housing 42 thereof or may be part of light housing head 24 or may be provided in another convenient manner. It is noted that one or more raised bosses 60, 62, 420, 422 may be defined by raised structure or by one or more complementary recesses in the structure.

While the configuration of the respective complementary bosses of the light body and the light bar may be newly configured in a particular instance, such is not required in all cases. In instances where the light body 20 of an existing light is employed, e.g., the body of a light of the STINGER® family of lights sold by Streamlight, Inc. of Eagleville, Pa., as illustrated, is employed, the configuration of the bosses of light body 20 are predefined and adapter base 400 is configured so as to be complementary thereto to define only one orientation where adapter base 400 can be seated in the open end 12' of light body 20.

Either of connector 50, 250 may have pins and the other may have sockets, or each may have a pin and a socket, or another connection configuration may be employed, as may be convenient or desired in a particular instance. Each of connectors 50, 350 may have spring loaded contacts that are displaceable axially when making contact with each other.

Each of the U.S. Provisional applications, U.S. patent applications, and/or U.S. patents identified herein are hereby incorporated herein by reference in their entirety, for any purpose and for all purposes irrespective of how it may be referred to herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light and light source adapter comprising:

a light body having an open end for receiving a light source therein, the open end exposing a face including one or more raised bosses extending axially toward the open end in an asymmetric pattern and one or more electrical connections, said light body having a cavity for receiving a source of electrical power therein and optionally including an electrical switch for selectively energizing at least one of the electrical connections;

a light source including an adapter base disposed in the open end of said light body, said adapter base having one or more raised bosses extending into the open end of said light body, said one or more raised bosses being in an asymmetric pattern that is complementary to the asymmetric pattern of the one or more raised bosses extending from the face of said light body, the one or more raised bosses extending from the face of said light body and the one or more raised bosses extending into the open end of said light body being complementary and asymmetric in that said adapter base cannot seat adjacent said face unless their complementary raised bosses are in a unique predetermined rotational relationship relative to each other for mating;

said adapter base including one or more electrical connections that are located to mate with the one or more electrical connections on the exposed face only when said adapter base is seated adjacent said face in the unique predetermined rotational relationship for mating;

whereby the orientation of said light source is uniquely predetermined relative to light body, said light source including a source of illumination electrically connected to the one or more electrical connections of said adapter base; and a retainer for retaining said light source disposed in the open end of said light body with said adapter base seated adjacent said face in the unique predetermined rotational relationship for mating.

2. The portable light and light source adapter of claim 1 wherein said light source comprises an elongated light bar including:

an elongated tubular transparent or translucent housing extending from said adapter base; and a plurality of light emitting diodes disposed on an elongated support disposed in said elongated tubular housing.

3. The portable light and light source adapter of claim 2 wherein said light emitting diodes are disposed on one surface of said elongated support for directing light to the side of said tubular housing when energized.

4. The portable light and light source adapter of claim 2 wherein said elongated support includes an electrical circuit board having conductors thereon for connecting said plurality of light emitting diodes to the one or more electrical connections of said adapter base.

5. The portable light and light source adapter of claim 4 wherein said electrical circuit board includes an electronic circuit for controlling the voltage applied to and/or the current flowing through said plurality of light emitting diodes.

6. The portable light and light source adapter of claim 4 wherein said elongated support includes:

an electrical circuit board having conductors thereon for connecting said plurality of light emitting diodes to the one or more electrical connections of said adapter base; and a heat conductive member adjacent said electrical circuit board and thermally coupled thereto.

7. The portable light and light source adapter of claim 1 wherein said retainer includes a retainer ring having threads thereon for engaging threads at the open end of said light body.

8. The portable light and light source adapter of claim 1 wherein the one or more raised bosses that extend axially toward the open end of said light body in an asymmetric pattern define a curved boss over an angle of less than about 180° and wherein the one or more raised bosses of said adapter base that extend into the open end of said light body define a curved boss over an angle complementary to that of the curved boss of said light body.

9. A light source adapter for a portable light, the portable light comprising a light body having an open end for receiving a light source therein, the open end exposing a face including one or more raised bosses extending axially toward the open end in an asymmetric pattern and one or more electrical connections, the light body having a cavity for receiving a source of electrical power therein and optionally including an electrical switch for selectively energizing at least one of the one or more electrical connections;

said light source adapter comprising:

a light source including an adapter base disposable in the open end of the light body, said adapter base having one or more raised bosses for extending into the open end of the light body, said one or more raised bosses being in an asymmetric pattern that is complementary to the asymmetric pattern of the one or more raised bosses extending from the face of the light body, the one or more raised bosses extending from the face of said light body and the one or more raised bosses extending into the open end of said light body being complementary and asymmetric in that said adapter base cannot seat adjacent the face unless their complementary raised bosses are in a unique predetermined rotational relationship for mating;

said adapter base including one or more electrical connections to mate with the one or more electrical connections on the exposed face only when said adapter base is seated adjacent the face in the unique predetermined rotational relationship for mating;

said light source including a source of illumination electrically connected to the at least two electrical connections of said adapter base.

10. The light source adapter for a portable light of claim 9 wherein said light source comprises an elongated light bar including:

an elongated tubular transparent or translucent housing extending from said adapter base; and a plurality of light emitting diodes disposed on an elongated support disposed in said elongated tubular housing.

11. The light source adapter for a portable light of claim 10 wherein said light emitting diodes are disposed on one surface of said elongated support for directing light to the side of said tubular housing when energized.

12. The light source adapter for a portable light of claim 10 wherein said elongated support includes an electrical circuit board having conductors thereon for connecting said plurality of light emitting diodes to the one or more electrical connections of said adapter base.

13. The light source adapter for a portable light of claim 12 wherein said electrical circuit board includes an electronic circuit for controlling the voltage applied to and/or the current flowing through said plurality of light emitting diodes.

14. The light source adapter for a portable light of claim 12 wherein said elongated support includes:

an electrical circuit board having conductors thereon for connecting said plurality of light emitting diodes to the one or more electrical connections of said adapter base; and a heat conductive member adjacent said electrical circuit board and thermally coupled thereto.

15. The light source adapter for a portable light of claim 9 further comprising:

a retainer for retaining said light source disposed in the open end of the light body with said adapter base seated adjacent the face in the unique predetermined rotational relationship for mating.

16. The light source adapter for a portable light of claim 15 wherein said retainer includes a retainer ring having threads thereon for engaging threads at the open end of said light body.

17. The light source adapter for a portable light of claim 9 wherein the one or more raised bosses that extend axially toward the open end of the light body in an asymmetric pattern define a curved boss over an angle of less than about 180° and wherein the one or more raised bosses of said adapter base that extend into the open end of said light body define a curved boss over an angle complementary to that of the curved boss of said light body.

18. A portable light and light source adapter comprising:

a light body having an open end for receiving a light source therein, the open end having an exposed a face including one or more features in an asymmetric pattern and one or more electrical connections, said light body having a cavity for receiving a source of electrical power therein and optionally including an electrical switch for selectively energizing at least one of the electrical connections;

a light source for emitting light in a predetermined direction relative to said light body and including an adapter base disposed in the open end of said light body, said adapter base having one or more features complementary to the features of said light body in an asymmetric pattern that is complementary to the asymmetric pattern of the one or more features of the face of said light body, the one or more raised bosses extending from the face of said light body and the one or more raised bosses extending into the open end of said light body being complementary and asymmetric in that said adapter base cannot seat adjacent said face unless their complementary features are in a unique predetermined rotational relationship for mating;

whereby said light source when disposed in said light body can emit light in the predetermined direction relative to the light body.

19. The portable light and light source adapter of claim 18 wherein said adapter base includes one or more electrical connections that are located to mate with the one or more electrical connections on the exposed face only when said adapter base is seated adjacent said face in the unique predetermined rotational relationship for mating.

20. The portable light and light source adapter of claim 18 wherein said light source includes a source of illumination electrically connected to the one or more electrical connections of said adapter base for emitting light in the predetermined direction.

21. The portable light and light source adapter of claim 18 further comprising a retainer for retaining said light source in the open end of said light body with said adapter base seated adjacent said face in the unique predetermined rotational relationship for mating.

22. The portable light and light source adapter of claim 21 wherein said retainer includes a retainer ring having threads thereon for engaging threads at the open end of said light body.

23. The portable light and light source adapter of claim 18 wherein said light source comprises an elongated light bar including:

an elongated tubular transparent or translucent housing extending from said adapter base; and a plurality of light emitting diodes disposed on an elongated support disposed in said elongated tubular housing for emitting light in the predetermined direction.

24. The portable light and light source adapter of claim 23 wherein said light emitting diodes are disposed on one surface of said elongated support for directing light to the side of said tubular housing when energized.

25. The portable light and light source adapter of claim 23 wherein said elongated support includes an electrical circuit board having conductors thereon for connecting said plurality of light emitting diodes to the one or more electrical connections of said adapter base.

26. The portable light and light source adapter of claim 25 wherein said electrical circuit board includes an electronic circuit for controlling the voltage applied to and/or the current flowing through said plurality of light emitting diodes.

27. The portable light and light source adapter of claim 23 wherein said elongated support includes:

an electrical circuit board having conductors thereon for connecting said plurality of light emitting diodes to the one or more electrical connections of said adapter base; and a heat conductive member adjacent said electrical circuit board and thermally coupled thereto.

28. The portable light and light source adapter of claim 18 wherein the one or more features of said light body include one or more raised bosses that extend axially toward the open end of said light body in an asymmetric pattern define a curved boss over an angle of less than about 180° and wherein the one or more features of said light source include one or more raised bosses of said adapter base that extend into the open end of said light body define a curved boss over an angle complementary to that of the curved boss of said light body.

* * * * *